US007724611B2

(12) United States Patent
Groothuis et al.

(10) Patent No.: US 7,724,611 B2
(45) Date of Patent: May 25, 2010

(54) DAY OF THE MONTH DISPLAY MECHANISM FOR WATCH MOVEMENT

(75) Inventors: Michiel Groothuis, St. Imier (CH); Eric Marki, Therwil (CH)

(73) Assignee: Ronda AG, Lausen (CH)

( * ) Notice: Subject to any disclaimer, the term of this patent is extended or adjusted under 35 U.S.C. 154(b) by 388 days.

(21) Appl. No.: 11/238,751

(22) Filed: Sep. 29, 2005

(65) Prior Publication Data

US 2006/0028918 A1 Feb. 9, 2006

Related U.S. Application Data

(63) Continuation of application No. PCT/EP2004/050370, filed on Mar. 26, 2004.

(30) Foreign Application Priority Data

Apr. 2, 2003 (CH) ..... 0571/03

(51) Int. Cl.
*G04B 19/20* (2006.01)

(52) U.S. Cl. ..... 368/37; 368/223

(58) Field of Classification Search ..... 368/37–40, 368/220–222, 77, 233, 223
See application file for complete search history.

(56) References Cited

U.S. PATENT DOCUMENTS 3,645,086 A * 2/1972 Niznik ..... 368/35
4,048,795 A 9/1977 Risi
5,711,100 A * 1/1998 Elmer ..... 40/592
6,081,483 A * 6/2000 Capt et al. ..... 368/28
6,711,100 B2 * 3/2004 Rochat et al. ..... 368/35

(Continued)

FOREIGN PATENT DOCUMENTS

DE 201 03 818 U1 3/2001

(Continued)

OTHER PUBLICATIONS

Antiquorum—antiquorum.com/eng/brandindex/pages/catalog_action=load&lotid=391&auctionid=151.html; Aug. 27, 2009.*

(Continued)

*Primary Examiner*—Vit W Miska
*Assistant Examiner*—Sean Kayes
(74) *Attorney, Agent, or Firm*—Peaerne & Gordon LLP

(57) ABSTRACT

Day of the month display mechanism for watch movement, comprising two mobiles (1), each bearing a sequence of digits (10). The two mobiles are disposed in such a manner that, at least for certain dates, the day of the month (3) displayed to the user corresponds to the combination of indications borne by the first mobile (1) and of indications borne by the second mobile (2), whilst for other dates, the day of the month (3) corresponds to the combination of two digits borne by the same mobile (2). The second mobile (2) is driven by the first mobile (1) through a star wheel (50) held by a jumper (51) to prevent the undesired rotation of said star. A banking element (511) is arranged in a manner to prevent said jumper from passing directly from one tooth (501) of the star to a non-adjacent tooth when the date changes.

25 Claims, 5 Drawing Sheets

U.S. PATENT DOCUMENTS

| | | | | |
|---|---|---|---|---|
| 6,735,151 | B2 * | 5/2004 | Triponez | 368/35 |
| 7,027,360 | B2 * | 4/2006 | Kitahara et al. | 368/28 |
| 2002/0024887 | A1 | 2/2002 | Triponez | |
| 2004/0105347 | A1 * | 6/2004 | Fujimori et al. | 368/293 |

FOREIGN PATENT DOCUMENTS

WO WO 03/071361 A2 8/2003

OTHER PUBLICATIONS

The front page, back page, summary table and pp. 16 to 25 of a catalogue concerning the Cabinet 2 watch, which is the model of the Jules Audemars series equipped with a device displaying the date in big size. (Feb. 2002) (12 pages).

A corresponding brochure specifically concerning the Cabent 2 watch, including a detailed description of the layout and operation of the innovative date display device called "big date". (2 pages).

A press release dedicated to said Cabinet 2 watch and published in the year 2000. Available only in French (3 pages).

The users guide "Tourbillon, Repetition Minutes, Quantiem Perpetual, Grande Date" for the calibre 2869 with correspsonding figures, this calibre being inside the Cabinet 2 watches and being equipped with said date display device. In French only (13 pages).

Invoices concerning the sale of Cabinet 2 watches purportedly also achieved in USA (10 pages), though there is no explicit/verbal reference to "Cabinet 2"; all these documents seem to indicate a date in 2000; furthermore, these documents have been altered so that they do not show any amounts.

Pictures and technical drawings showing the detail in the layout and operation of the Grande Date display which i is built into the Cabinet 2 watches sold in the USA and other countries before Apr. 2, 2003. (3 pages).

* cited by examiner

DAY OF THE MONTH DISPLAY MECHANISM FOR WATCH MOVEMENT

REFERENCE DATA

This application is a continuation of International Patent Application 2004WO-EP05037 (WO04088435) filed on Mar. 26, 2004, claiming priority of Swiss patent application 2003CH-0571 of Apr. 2, 2003, the contents whereof are hereby incorporated.

FIELD OF THE INVENTION

The present invention concerns a day of the month display mechanism for watch movement, in particular a large-size day of the month display mechanism.

DESCRIPTION OF RELATED ART

Watch movements with hands for displaying the day of the month more often than not use an annular date disc with 31 positions, the days of the month from 1 to 31 being printed on these positions. The date disc is indexed each day by one position, so as to show each day another date through an aperture in the dial. Each indexation position thus occupies an angular portion of 360°/31, on which a date with one or two digits must be indicated; the maximal size of the displayed numbers is thus limited.

Different systems are known that allow dates of a larger size to be displayed. The known systems often use two distinct mobiles, one for the date's tens and one for the date's units; a mechanical or electromechanical control system makes it possible to display each day the correct ten and unit combination through the aperture or apertures.

International application WO9913383 (Jaquet SA) describes a mechanism for displaying a large size calendar date in which the units are displayed by an annular disc and the tens by a cross of which one of the branches covers a portion of the units' annular disc. The units disc bears three times the sequence of digits 0 to 9 plus an intermediary 1, corresponding to the sequence of the units for the numbers from 0 to 31. The cross's branches bear the numbers 0 to 3 respectively. An aperture on the dial is provided to display both the portion of the cross covering the annular disc and the next units number on the right of the cross.

This disposition has the disadvantage of requiring considerable modifications of the mechanism if one wishes to display the date at another place, for example at three o'clock or at six o'clock rather than at 12 o'clock. In this case, the axis of the tens' cross must be moved and the entire driving system must be adapted accordingly.

Furthermore, the units' cross occupies a considerably space at the watch's center; this space is thus not available for other displays, for example for the axis of hands for auxiliary functions such as chronometer, power reserve, day of the week display etc. In any case, the size of the tens' cross, and thus the maximal size of the displayed date digits, is limited by the distance between the units' disc and the seconds' axis.

In this solution, the tens' and units' digits are in any case displayed by mobiles moving in two different planes; there is thus, for all the dates, a difference in depth between the tens' digit and the units' digit, which is visible through the date aperture.

Furthermore, in this solution, the tens' star wheel is driven by the units' annular disc through a star wheel engaging with the internal units' disc and held by a jumper. When the date changes, in particular during a manual correction of the date, the star wheel sometimes risks being driven with an energy sufficient for the jumper to pass directly from one tooth, or branch, to a non-neighboring tooth of the star. In this case, the correspondence between the tens and the units is irrevocably destroyed; the watch could for example display the dates 32, 33 etc. To limit this risk, though without suppressing it completely, it would thus be necessary to use a jumper holding the star that is actuated by a sufficiently strong spring; this solution however has the disadvantage of considerably increasing the power and the energy required for changing the date. Motors must thus be oversized only to act on the jumper and the electric consumption is increased accordingly.

One aim of the present invention is to propose a day of the month display mechanism that avoids these disadvantages.

BRIEF SUMMARY OF THE INVENTION

According to the invention, these problems are solved by means of a watch having the characteristics of the independent claims, preferred characteristics being further indicated in the dependent claims.

In particular, these problems are solved thanks to a day of the month display mechanism for watch movement, comprising a first mobile bearing a first sequence of digits and a second mobile bearing a second sequence of digits. The two mobiles are arranged and disposed in such a manner that, at least for certain dates, the day of the month displayed to the user corresponds to the combination of indications borne by the first mobile and of indications borne by the second mobile, whilst for at least another date, the displayed day of the month corresponds to the combination of two digits or of a digit and of a space borne by the same mobile.

The inventive display mechanism is thus a combination between a large date display mechanism, with two digits borne by two distinct mobiles, and a conventional day of the month display mechanism for other dates, for which the date's single digit or two digits are borne by the same mobile. One can thus avoid, at least for certain dates, the disadvantages of a display through two distinct mobiles without having to forgo the displaying of large size dates.

This solution further allows the number of indications borne by the two mobiles to be balanced by reporting certain units' indications on the tens' disc and/or certain tens' indications on the units' disc, so as to be able to display dates of the largest possible size.

The two mobiles are preferably constituted by two concentric and preferably superimposed annular discs. One thus avoids occupying portions of the upper surface of the movement that could be used by other displays. Furthermore, the date can be displayed at any angular position on the dial merely by replacing the annular discs, without modifying nor moving the driving mechanism.

These aims are also achieved by means of a day of the month display mechanism for watch movement, comprising a first mobile bearing a first sequence of digits and a second mobile bearing a second sequence of digits. The two mobiles are arranged and disposed in such a manner that, at least for certain dates, the day of the month displayed to the user corresponds to the combination of indications borne by the first mobile and of indications borne by the second mobile. The second mobile, for example the mobile bearing at least certain tens, is driven by the other mobile, for example the mobile bearing at least certain units, through a star wheel held by a jumper. A banking element is arranged so as to prevent the jumper from passing directly from one tooth of the star to a non-adjacent tooth when the date changes.

This solution has the advantage of reducing or eliminating the risk that the second disc is indexed erroneously by two positions instead of a single one when the date changes, in particular during manual correction of the date. It is thus possible to reduce without risk the spring's force acting on the jumper holding the star, which allows the energy and power necessary for changing the date's tens to be reduced.

BRIEF DESCRIPTION OF THE DRAWINGS

The invention will be better understood by reading the description illustrated by the attached figures that show.

DETAILED DESCRIPTION OF POSSIBLE EMBODIMENTS OF THE INVENTION

Figure 1B:
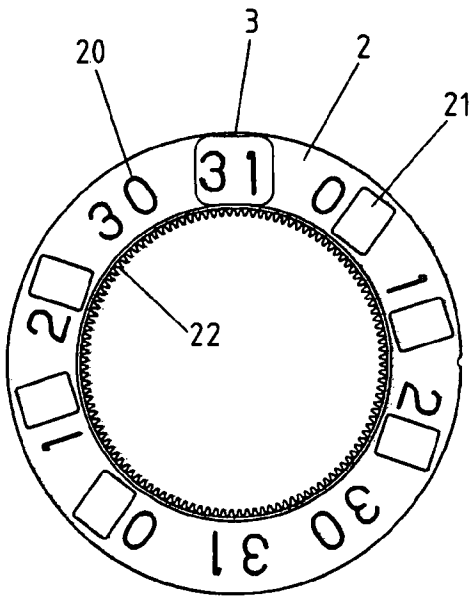
FIG. 1*b* a top view of the tens' ring in the first embodiment of the invention.
Figure 1A:
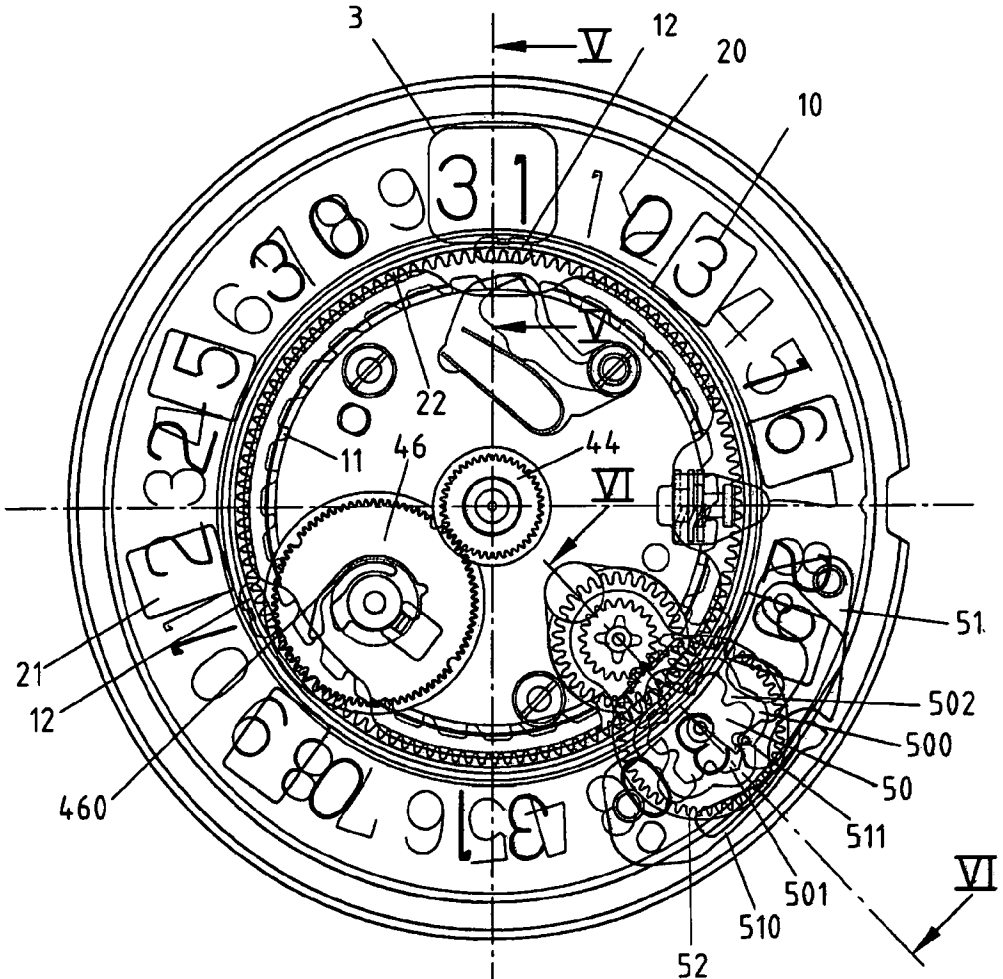
FIG. 1*a* a top view of the driving mechanism according to a first embodiment of the invention.

FIG. 1 shows a top view of the date driving mechanism according to a first embodiment of the invention; only the parts that are useful for understanding the mechanism have been represented in full lines to make the figure easier to understand.

The mechanism comprises two mobiles constituted in this example by two concentric and superimposed annular discs 1 and 2. The first mobile 1, or units' ring, bears a sequence of digits 10 {1,2,3,4,5,6,7,8,9,0,1,2,3,4,5,6,7,8,9,0,1,2,3,4,5,6,7,8,9}. The digits are regularly spaced with the exception of a greater interval between the last 9 and the first 1 which is sufficient for displaying a two-digit date, as will be seen further below. In the illustrated embodiment, the days of the month are designed to be displayed at twelve o'clock on the dial; the units' digits are thus placed nearly radially, so as to appear vertically when they are seen through a vertical aperture just right of the twelve o'clock position.

Figure 5:
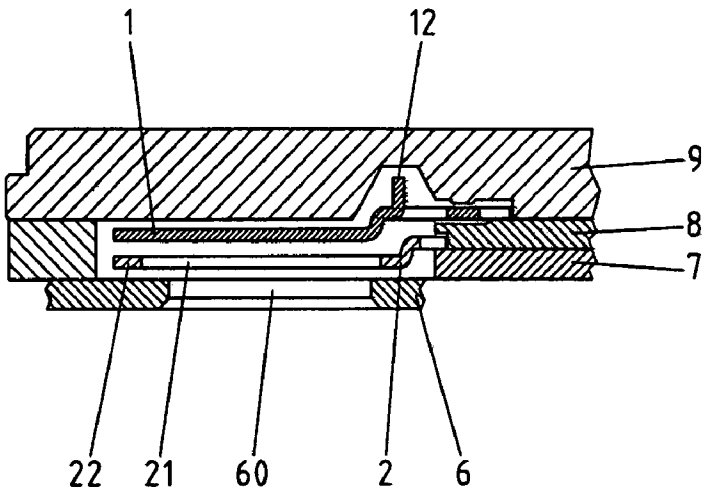
FIG. 5 a partial cross section along the axis V-V of the driving mechanism according the invention.
Figure 6:
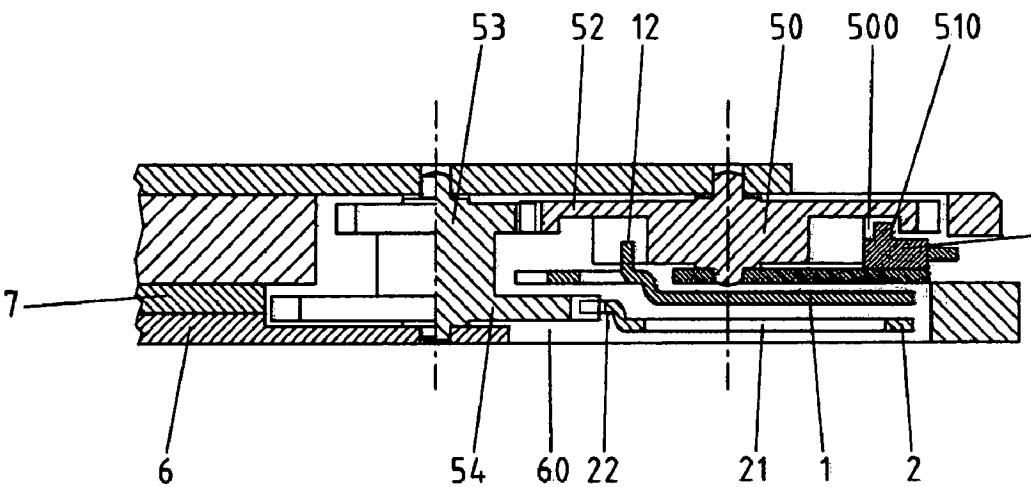
FIG. 6 a partial cross section along the axis VI-VI of the driving mechanism according the invention.

The second mobile, or tens' ring, is constituted by a second ring 2 turning in concentric fashion above the units' ring 1, as can be seen particularly in FIGS. 5 and 6. It must be observed that on these figures, the dial 6 of the watch is located on the bottom. As can be seen in particular in FIG. 1*b*, the second ring 2 bears in this embodiment the sequence {0,1,2,30,31,0,1,2,30,31}. A vertical window 21 is stamped through the tens' ring 2 on the right of the digits 0, 1 and 2, allowing the digits 10 borne by the units' ring 1 to be seen.

In a variant embodiment of the invention, not represented, the second mobile 2 could be constituted by a non-annular element, for example by a cross or a star turning above the first mobile 1, and provided with non-rectangular blanks 21, for example in the manner suggested in the mentioned document WO9913383. Furthermore, the tens' mobile could bear a single sequence {0,1,2,30,31} or more than twice this sequence. A single sequence however has the disadvantage of requiring considerable angular steps at each indexation of the mobile, whilst the display of a greater number of sequences by necessity requires the use of smaller digits.

In another variant embodiment of the invention, not represented, the two mobiles could be concentric but of different diameter, and thus not superimposed or partially superimposed. In this case, at least one of the two annular discs could bear blanks in the form of internal or external radial flaps to cover the digits or indications borne by the other mobile at certain dates.

Furthermore, the one skilled in the art will understand that the blanks provided in the different embodiments of the invention could also be constituted by transparent portions of one of the two mobiles.

The arrangement of the digits 10, 20 and the inclination of the windows 21 depend on the position chosen for displaying the date on the dial; for example, to display the date at three o'clock, it is necessary to pivot both the digits 10, 20 and the windows 21 by 90°. In this arrangement, the digits and the windows occupy a greater angular segment so that one will possibly adopt a number of sequences different from 2 on the tens' ring 2. The rotation angle depends of course on the angular position of the aperture.

In this embodiment of the invention, the date 3 displayed through the aperture 60 in the dial 6 is generally formed of a digit 20 from the tens' ring 2 and of a second digit 10 from the units' ring 1, visible through a window 21. However, the $30^{th}$ and $31^{st}$ of the month, the date 3 displayed to the watch's user comprises two digits borne both by the tens' ring 2. One thus avoids, for these particular dates, the problem of the difference in depth between the tens' digit and the units' digit.

The maximal size of the dates displayed in a conventional large size date display corresponds to the maximal size of the digits one can place both on the tens' and the units' mobile. By choosing to display certain dates with the aid of two digits from the same mobile, one gains the possibility of moving certain indications from one mobile to another, which allows at least for certain configurations the size of the digits that can be displayed to be increased.

Figure 2:
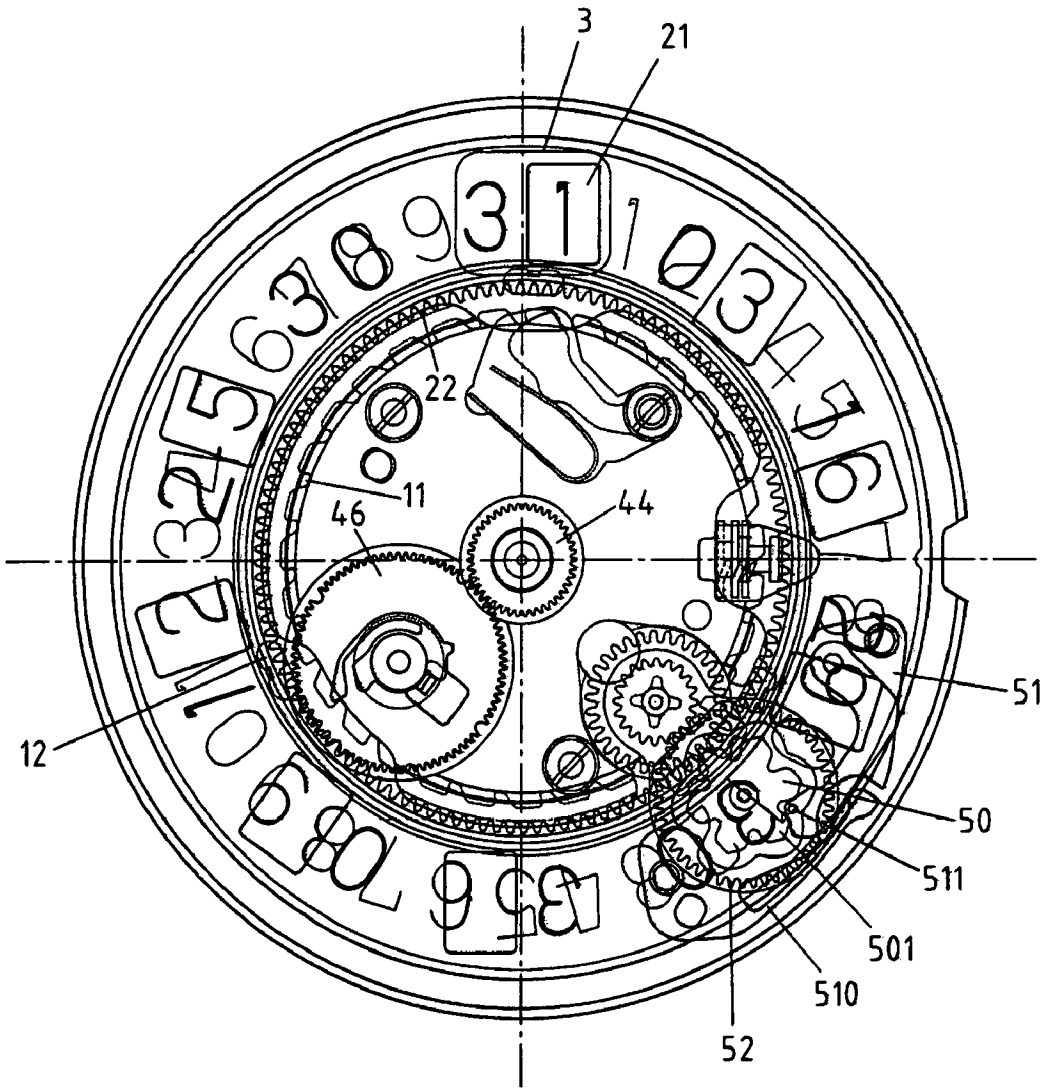
FIG. 2 a top view of the driving mechanism according to a second embodiment of the invention.

In the variant embodiment of FIG. 2, the units' ring 1 bears the sequence of digits 10 {1,1,2,3,4,5,6,7,8,9,0,1,2,3,4,5,6,7,8,9, 0,1,2,3,4,5,6,7,8,9} whilst the tens' ring bears the sequence of digits 20 {0,1,2,30,3,0,1,2,30,3}, the '0' being replaceable by spaces. This configuration allows all the days of the month to be displayed with the aid of indications borne by the two mobiles 1, 2 with the exception of the date 30 which is indicated by means of two digits borne by the tens' ring 2.

Figure 3:
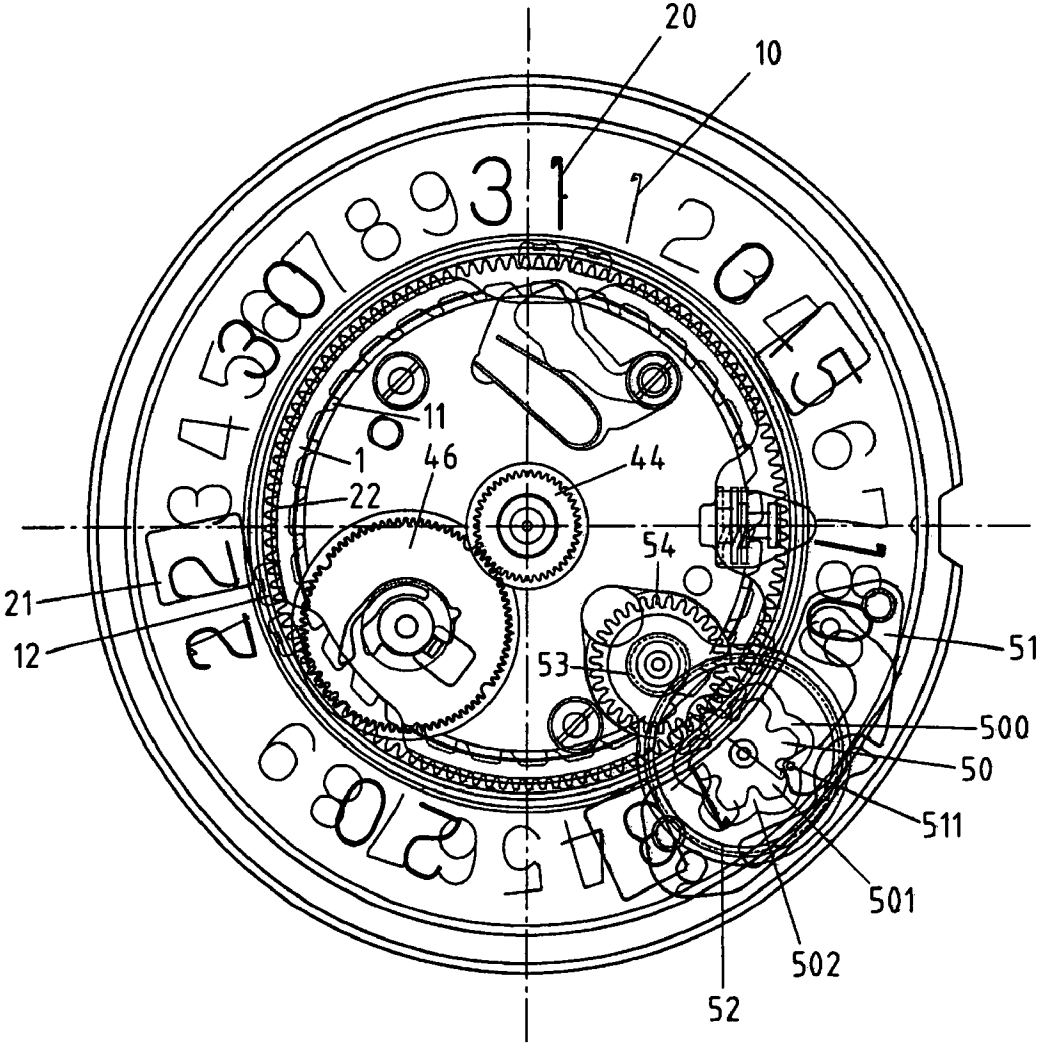
FIG. 3 a top view of the driving mechanism according to a third embodiment of the invention.

In the variant embodiment of FIG. 3, the units' ring 1 bears the sequence of digits 10 {1,2,3,4,5,6,7,8,9} repeated three times whilst the tens' ring bears the sequence of digits 20 {0,10,1,20,2,30,31}. This configuration allows all the days of the month to be displayed with the aid of indications borne by the two mobiles 1,2 with the exception of the dates 10, 20, 30 and 31 which are indicated by means of two digits borne by the tens' ring 2.

Figure 4:
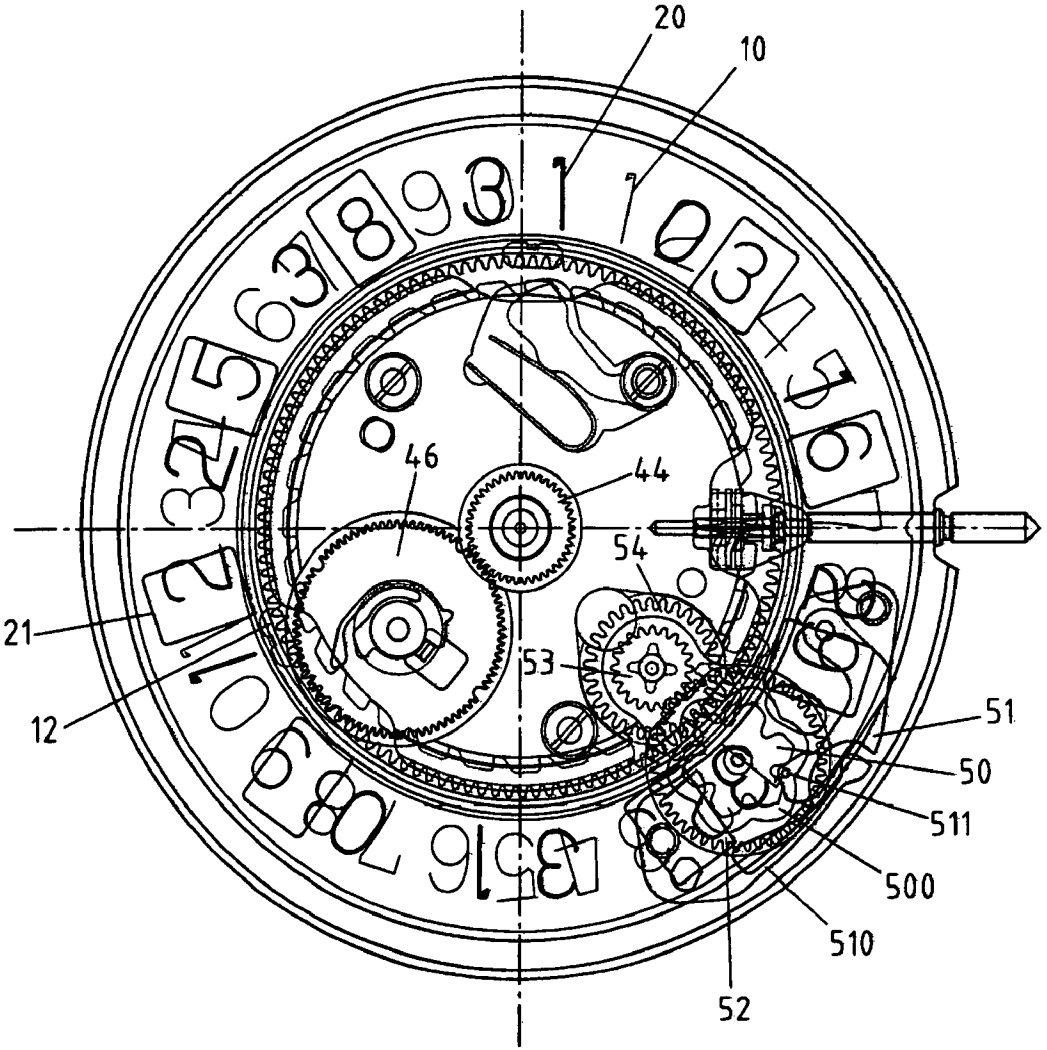
FIG. 4 a top view of the driving mechanism according to a fourth embodiment of the invention.

The one skilled in the art will understand that other variant embodiments are conceivable within the frame of this invention. For example, in FIG. 4, the units' ring 1 bears the sequence of digits 10 {1,2,3,4,5,6,7,8,9,0,1,2,3,4,5,6,7,8,9,0, 1,2,3,4,5,6,7,8,9,0}, whilst the tens' ring bears the sequence of digits 20 {0,1,2,3,31,0,1,2,3,31}. This configuration allows all the days of the month to be displayed with the aid of indications borne by the two mobiles 1, 2 with the exception of the date 31 which is indicated by means of two digits borne by the tens' ring 2. In another variant embodiment, not represented, the days of the month corresponding to the dates 1 to 9 are displayed with the aid of a single mobile; this allows for example this day of the month to be displayed with the aid of a single digit which can also be centered in the aperture 60.

It would also be possible to display certain days of the month with the aid of two digits borne by the units' ring 1, by displaying certain tens' indications on the units' disc. For example, one could conceive that the units' disc bears the date 30 or the date 31 in full. This variant embodiment however has the disadvantage of requiring windows 21 of large size through the tens' ring 2, which risks weakening this ring and moreover occupies more space. Furthermore, one could also imagine that certain days of the month are displayed with the aid of two digits borne by the units' ring, others with the aid of two digits from the tens' ring and yet others with the aid of two digits borne by the two rings. Finally, one could in particular for larger size watches use a units' disc turning over the tens' disc and provided with windows for seeing the tens' indications on the second disc.

Movements are also known in which the date is displayed with the aid of literal indications, for example with an indication of the month for perpetual calendars and/or with an indication of the day of the week. One will thus understand that the invention also applies to this type of movements for which the different indications constituting the date are borne by a variable number of mobiles according to the date. For example, it would be possible within the frame of the invention to display the day of the week and/or the month in the same aperture 60 or in one or two additional apertures, the day of the week and/or the month being indicated by one or several mobiles according to the date.

Furthermore, the indication of the tens and the indication of the units can be displayed in two distinct apertures juxtaposed or placed at different places of the dial, for example at ten o'clock and at two o'clock.

We will now describe with the aid of FIGS. 1, 5 and 6 the driving mechanism of the two mobiles 1, 2. In this embodiment, the two mobiles are driven by the same electromechanical or mechanical motor (not represented) and set by the same winding button; it would however also be possible to drive and/or set the two mobiles with two independent motors or by a single motor but through two distinct cinematic chains.

A pinion 44 actuated by a motor (not represented) drives a wheel 46 on the axis of which a ratchet device 460 is mounted and arranged so as to cause the rotation, each day, at midnight or at another moment, of the internal gear teeth 11 of the units' ring 1. In this embodiment, the ring 1 is thus indexed each day by 360/31 degrees in order to complete one turn for each month of 31 days.

One could also within the frame of this invention conceive mechanisms in which the change of date does not occur at midnight, as well as mechanisms in which the disc 1 performs one turn during a period different from 31 days.

The units' ring 1 comprises driving bankings 12 constituted by portions folded by stamping of the ring 1. As can be seen in particular on the cross section of FIG. 6, these bankings allow a gear element 50 to be indexed, in this example a six-tooth or six-branch star wheel indexed by 60° at each contact with the bankings 12. The bankings 12 are placed radially on the ring 1 so that one banking actuates the star each time a rotation of the tens' ring 2 is desired. In the embodiment of FIG. 1, the tens' ring is actuated 5 times a month:

on the $10^{th}$ of the month, when passing from the ten 0 to the ten 1;

on the $20^{th}$, when passing from the ten 1 to the ten 2;

on the $30^{th}$, when passing from the ten 2 to 30;

on the $31^{st}$, when passing from the $30^{th}$ to the 31'; and on the $1^{st}$, when passing from the $31^{st}$ to the ten 0.

The number and the instant of the rotations of the tens' ring depend on the sequences on the two mobiles 1 and 2, as can be seen by comparing the position of the bankings 12 on the variant embodiments of FIGS. 1 to 4.

The star wheel 50 drives at each rotation a wheel 52 mounted on the same axis, which itself actuates a wheel 53. The wheel 53 is mounted on the axis of a wheel 54 engaging with the internal gear teeth 22 of the tens' ring 2. The engaging ratio between the wheels 50 and 53 is chosen so that the indexing angle of the ring 2 caused by a displacement of the star 50 corresponds to the angular distance between two tens' digits.

The star wheel 50 is held by a jumper 51 pressing against the interstice 502 between two teeth 501 of the star 50 by a spring 510. The jumper makes it possible to prevent the star 50 from turning freely, in particular when it is driven by a catch banking 12. In order to force the jumper 51 to move close to the bottom of the interstice 502 between two teeth 501, it is provided by a banking element 511, constituted here by a pin perpendicular to the watch's plane, moving in a slide way 500 machined in the wheel 52. The shape of the slide way 500 prevents the pin 511 from jumping directly from one interstice 502 to a non-adjacent interstice between two teeth of the star 50; it thus surrounds the star wheel 50 by approximately marrying its contours.

As can be seen in particular in FIG. 5, the first mobile 1 slides directly on the upper bridge 9 of the watch movement, and is held by a first plate 8 mounted over this bridge. The second mobile 2 slides on a ring path over this first plate 8 and is held by a second plate 7. The dial 6 is fastened over the second plate and provided with an aperture 60 to display the days of the month borne by the first and/or second mobile.

What is claimed is:

1. Day of the month display mechanism for watch movement, comprising: a first mobile bearing a first sequence of digits, a second mobile bearing a second sequence of digits, said mobiles being arranged and disposed in such a manner that, at least for certain dates, the day of the month displayed to the user corresponds to the combination of indications borne by the first mobile and of indications borne by the second mobile, characterized in that said mobiles are arranged and disposed in such a manner that, at least for another date, the day of the month displayed to the user corresponds to the combination of two digits or of a digit and of at least one space borne by the same mobile.

2. The mechanism of claim 1, wherein the rotation of the second mobile is held by a jumper acting on the teeth of a gear element, said jumper being disposed in a manner to prevent the undesired rotation of said gear element, a banking element being arranged in a manner to prevent said jumper from passing directly from one tooth of said gear element to a non-adjacent tooth when the date changes.

3. The mechanism of claim 2, wherein said banking element is connected to said jumper and moves in a slide way shaped so as to force said jumper to move close to the bottom of the interstice between two said teeth.

4. The mechanism of claim 1, wherein said first mobile bears the units of said days of the month and said second mobile bears the tens of said days of the month.

5. The mechanism of claim 1, wherein said first mobile bears the units of the days of the month as well as the days 1 to 9 in full.

6. The mechanism of claim 5, wherein said second mobile bears the tens of the days of the month as well as the date 30 and/or the date 31 in full.

7. The mechanism of claim 1, wherein: said first mobile bears the units of at least certain days of the month, said second mobile bears the tens of at least certain days of the month as well as blanks for showing the units' digits to be displayed.

8. The mechanism of claim 1, wherein: said first mobile bears the tens of at least certain days of the month, said second mobile bears the units of at least certain days of the month as well as blanks for showing the tens' digits to be displayed.

9. The mechanism of claim 1, wherein said mobiles are constituted by two concentric annular discs.

10. The mechanism of claim 9, wherein said discs are centered around the center of the watch, and wherein the second mobile is provided with, and driven by, internal gear teeth.

11. The mechanism of claim 1, wherein said mobiles are driven by the same motor.

12. The mechanism of claim 11, wherein said mobiles are driven by the same motor through two distinct kinematic chains.

13. The mechanism of claim 1, wherein said mobiles are driven by two independent motors.

14. The mechanism of claim 1, further comprising an indication of the day of the week borne by one of said mobiles and/or by an additional mobile.

15. The mechanism of claim 1, wherein the first mobile comprises at least one sequence corresponding to the units of certain days of the month as well as at least one space corresponding to a unit and/or a ten of another day of the month borne on the second mobile.

16. The mechanism of claim 1, wherein said first mobile moves directly on the upper surface of said movement and is held by an intermediary plate comprising an annular path on which said second mobile moves.

17. The mechanism of claim 1, wherein said first mobile bears the units of the days of the months and said second mobile bears the numbers "0", "1", and "2" as tenths of the months, and wherein one of said mobiles bears the day 30 and the day 31 in full.

18. The mechanism of claim 1, wherein said days of the month are designed to be displayed at twelve o'clock on a dial, and wherein the units' digits are placed so as to appear vertically when said unit's digits are seen through a vertical aperture at twelve o'clock.

19. The Day of the month display mechanism for watch movement of claim 1, wherein said mobile is an annular element.

20. Day of the month display mechanism for watch movement, comprising: a first mobile bearing a first sequence of digits, a second mobile bearing a second sequence of digits, said mobiles being arranged and disposed in such a manner that, at least for certain dates, the day of the month displayed to the user corresponds to the combination of indications borne by the first mobile and of indications borne by the second mobile, characterized in that said mobiles are arranged and disposed in such a manner that, at least for another date, the day of the month displayed to the user corresponds to the combination of two digits or of a digit and of at least one space borne by the same mobile, wherein said first mobile bears the units of said days of the month and said second mobile bears the tens of said days of the month, and wherein said first mobile bears the units of the days of the months as well as the day 30 and/or the day 31 in full.

21. Day of the month display mechanism for watch movement, comprising: a first mobile bearing a first sequence of digits, a second mobile bearing a second sequence of digits, said mobiles being arranged and disposed in such a manner that, at least for certain dates, the day of the month displayed to the user corresponds to the combination of indications borne by the first mobile and of indications borne by the second mobile, characterized in that said mobiles are arranged and disposed in such a manner that, at least for another date, the day of the month displayed to the user corresponds to the combination of two digits or of a digit and of at least one space borne by the same mobile, wherein the first mobile comprises the sequence {1, 2, 3, 4, 5, 6, 7, 8, 9, 0}three times whilst the second mobile comprises the sequence {0, 1, 2, 3, 31} or the sequence {[space], 1, 2, 3, 31} at least once.

22. Day of the month display mechanism for watch movement, comprising: a first mobile bearing a first sequence of digits, a second mobile bearing a second sequence of digits, said mobiles being arranged and disposed in such a manner that, at least for certain dates, the day of the month displayed to the user corresponds to the combination of indications borne by the first mobile and of indications borne by the second mobile, characterized in that said mobiles are arranged and disposed in such a manner that, at least for another date, the day of the month displayed to the user corresponds to the combination of two digits or of a digit and of at least one space borne by the same mobile, wherein the first mobile comprises the sequence {1, 2, 3, 4, 5, 6, 7, 8, 9, 0} twice plus once the sequence {1, 2, 3, 4, 5, 6, 7, 8, 9, 0} whilst the second mobile comprises the sequence {0, 1, 2, 30, 31} at least once or the sequence {[space], 1, 2, 30, 31}.

23. Day of the month display mechanism for watch movement, comprising: a first mobile bearing a first sequence of digits, a second mobile bearing a second sequence of digits, said mobiles being arranged and disposed in such a manner that, at least for certain dates, the day of the month displayed to the user corresponds to the combination of indications borne by the first mobile and of indications borne by the second mobile, characterized in that said mobiles are arranged and disposed in such a manner that, at least for another date, the day of the month displayed to the user corresponds to the combination of two digits or of a digit and of at least one space borne by the same mobile, wherein the first mobile comprises the sequence {1, 2, 3, 4, 5, 6, 7, 8, 9, 0} and wherein the second mobile comprises at least once the sequence {2, blank, 30, 31, 0, blank}.

24. Day of the month display mechanism for watch movement, comprising: a first mobile bearing a first sequence of digits including a plurality of sequences such that each sequence comprises at least all the digits between 2 and 9, a second mobile bearing a second sequence of digits, said mobiles being arranged and disposed in such a manner that, at least for certain dates, the day of the month displayed to the user corresponds to the combination of indications borne by the first mobile and of indications borne by the second mobile, characterized in that said mobiles are arranged and disposed in such a manner that, at least for another date, the day of the month displayed to the user corresponds to the combination of two digits or of a digit and of at least one space borne by the same mobile.

25. Day of the month display mechanism for watch movement, comprising: a first mobile bearing a first sequence of digits, a second mobile bearing a second sequence of digits, said mobiles being arranged and disposed in such a manner that, at least for certain dates, the day of the month displayed to the user corresponds to the combination of indications borne by the first mobile and of indications borne by the second mobile, wherein said second mobile is held by a jumper acting on the teeth of a gear element, said jumper being arranged so as to prevent the undesired rotation of said gear element, a pin being arranged so as to prevent said jumper from passing directly from one tooth of said gear element to a non-adjacent tooth when the date changes, wherein said pin is connected perpendicularly to said jumper and moves in a slideway in said gear element shaped so as to force said jumper to move close to the bottom of an interstice between two of said teeth, and wherein said mobiles are driven by a common motor through two distinct kinematic chains.

* * * * *

UNITED STATES PATENT AND TRADEMARK OFFICE

CERTIFICATE OF CORRECTION

PATENT NO. : 7,724,611 B2
APPLICATION NO. : 11/238751
DATED : May 25, 2010
INVENTOR(S) : Michiel Groothuis and Eric Marki It is certified that error appears in the above-identified patent and that said Letters Patent is hereby corrected as shown below:

In the Specifications:

Column 5, Line 64: delete "31'", replace with "31st"

Signed and Sealed this

Seventh Day of September, 2010

David J. Kappos

David J. Kappos
*Director of the United States Patent and Trademark Office*